US009957829B2

(12) United States Patent
Shepherd

(10) Patent No.: US 9,957,829 B2
(45) Date of Patent: May 1, 2018

(54) ROTOR TIP CLEARANCE

(71) Applicant: Siemens Aktiengesellschaft, Munich (DE)

(72) Inventor: Andrew Shepherd, Branston (GB)

(73) Assignee: Siemens Aktiengesellschaft, Munich (DE)

( * ) Notice: Subject to any disclaimer, the term of this patent is extended or adjusted under 35 U.S.C. 154(b) by 240 days.

(21) Appl. No.: 14/890,939

(22) PCT Filed: May 12, 2014

(86) PCT No.: PCT/EP2014/059650

§ 371 (c)(1),
(2) Date: Nov. 13, 2015

(87) PCT Pub. No.: WO2014/191186

PCT Pub. Date: Dec. 4, 2014

(65) Prior Publication Data

US 2016/0102573 A1 Apr. 14, 2016

(30) Foreign Application Priority Data

May 29, 2013 (GB) ..... 1309580.7

(51) Int. Cl.
*F01D 11/12* (2006.01)
*F01D 11/14* (2006.01)
(Continued)

(52) U.S. Cl.
CPC ..... *F01D 11/122* (2013.01); *F01D 5/02* (2013.01); *F01D 5/12* (2013.01); *F01D 9/041* (2013.01);
(Continued)

(58) Field of Classification Search
CPC ..... F01D 11/14; Y10T 29/4924; Y10T 29/49295; Y10T 29/4932; Y10T 29/49321; Y10T 29/49323; Y10T 29/49325
See application file for complete search history.

(56) References Cited

U.S. PATENT DOCUMENTS 4,679,981 A * 7/1987 Guibert ..... F01D 11/08 415/116
4,767,272 A * 8/1988 Kildea ..... F01D 5/027 29/889.21
(Continued)

FOREIGN PATENT DOCUMENTS

EP 1172524 A2 1/2002
GB 1406098 A * 9/1975 ..... F01D 11/08

*Primary Examiner* — Jason L Vaughan
(74) *Attorney, Agent, or Firm* — Beusse Wolter Sanks & Maire

(57) ABSTRACT

A method of setting a clearance between a rotor and a stator of a rotor assembly for a turbine engine. The rotor assembly has a plurality of rotor-to-stator stages and the stator has a nominal centerline. Typically the stator is a casing or an array of vane tips. The method includes (i) correlating in-service rotor-to-stator rub patterns for a rotor-to-stator stage of a number of turbine engines, (ii) setting a position of a machining centerline relative to the nominal centerline of the stator, the position being towards a heavy rub, (iii) machining the stator about the machining centerline, (iv) repeating steps (i) to (ii) for each rotor-to-stator stage of the plurality of the rotor-to-stator stages, wherein the machined stator having been formed by at least two machining steps having different center-lines.

18 Claims, 4 Drawing Sheets

(51) Int. Cl.

| | |
|---|---|
| ***F01D 5/02*** | (2006.01) |
| ***F01D 5/12*** | (2006.01) |
| ***F01D 9/04*** | (2006.01) |
| ***F01D 25/24*** | (2006.01) |

(52) U.S. Cl.
CPC ..... *F01D 11/14* (2013.01); *F01D 25/24* (2013.01); *F05D 2220/32* (2013.01); *F05D 2230/10* (2013.01); *F05D 2240/12* (2013.01); *F05D 2240/307* (2013.01); *F05D 2240/55* (2013.01); *F05D 2300/611* (2013.01)

(56) References Cited

U.S. PATENT DOCUMENTS

| | | | | |
|---|---|---|---|---|
| 5,127,793 | A | 7/1992 | Walker et al. | |
| 5,667,358 | A * | 9/1997 | Gaul | F01D 11/24 415/173.1 |
| 6,109,843 | A | 8/2000 | Descoteaux | |
| 6,375,416 | B1 * | 4/2002 | Farrell | F01D 11/08 415/10 |
| 6,401,460 | B1 | 6/2002 | Xia | |
| 6,409,471 | B1 | 6/2002 | Stow | |
| 6,439,842 | B1 * | 8/2002 | Toomey | F01D 11/08 415/162 |
| 6,502,304 | B2 * | 1/2003 | Rigney | C23C 4/00 29/889.21 |
| 6,868,363 | B2 * | 3/2005 | Baran | G06F 17/5018 324/260 |
| 7,341,425 | B2 * | 3/2008 | Murooka | F01D 5/141 415/170.1 |
| 7,499,815 | B2 * | 3/2009 | Dischinger | G06F 17/5086 324/260 |
| 7,785,063 | B2 | 8/2010 | McQuiggan et al. | |
| 7,909,566 | B1 * | 3/2011 | Brostmeyer | F01D 11/22 415/132 |
| 8,126,628 | B2 * | 2/2012 | Hershey | F01D 11/24 244/75.1 |
| 8,177,476 | B2 * | 5/2012 | Andrew | F01D 11/14 415/1 |
| 8,177,501 | B2 | 5/2012 | Flanagan | |
| 8,197,197 | B2 | 6/2012 | Flanagan | |
| 8,876,460 | B2 * | 11/2014 | Willett, Jr. | F01D 11/001 29/889.21 |
| 8,970,228 | B2 * | 3/2015 | Andarawis | G01B 7/14 324/658 |
| 9,097,133 | B2 * | 8/2015 | Dong | F01D 11/08 |
| 9,587,511 | B2 * | 3/2017 | Willett, Jr. | G01B 11/14 |
| 2005/0086943 | A1 | 4/2005 | Grove et al. | |
| 2010/0296912 | A1 | 11/2010 | McCallum et al. | |
| 2014/0314579 | A1 * | 10/2014 | Kuwamura | F01D 11/001 416/223 R |
| 2015/0247417 | A1 * | 9/2015 | Bacic | F01D 11/20 415/1 |

* cited by examiner

ROTOR TIP CLEARANCE

CROSS REFERENCE TO RELATED APPLICATIONS

This application is the US National Stage of International Application No. PCT/EP2014/059650 filed 12 May 2014, and claims the benefit thereof. The International Application claims the benefit of Great Britain Application No. GB 1309580.7 filed 29 May 2013. All of the applications are incorporated by reference herein in their entirety.

FIELD OF INVENTION

The present invention relates to minimising clearance between a rotor and a stator for a turbine engine and in particular machining casings and aerofoils to minimise clearance.

BACKGROUND OF INVENTION

A compressor (or turbine) of a gas turbine engine comprises rotor components, including rotor blades and a rotor drum, and stator components, including stator vanes and a stator casing. The compressor is arranged with a number of alternating rotor blade and stator vane stages as is well known. The efficiency of the compressor is influenced by the running clearances or radial gap between its rotor and stator components. The radial gap or clearance between the rotor blades and stator casing and between the stator vanes and the rotor drum are set to be as small as possible to minimise over tip leakage of working gases.

Typically, the minimum clearance that can be set is determined by the transient variations of the clearance during engine operation. However, when engine demand changes the transient conditions cause the components to experience different thermal gradients and thermal lag. Along with changes of rotational speeds that influence radial position of components and different component materials the clearances are significantly affected during these transient engine conditions. In some locations the rotor and stator components are allowed to lightly touch, transiently, leaving a rub mark that can be seen.

In addition, rotor components can rotate eccentrically or 'wobble' about the engine's rotational axis. This eccentricity can contribute to rotor and stator rubbing. In particular, a rotor-stator rub can occur in only a discrete circumferential region. Also, when the engine is shutdown, and then restarted before it is fully cooled, the casings and rotor can be thermally distorted when the engine is restarted, causing rubs at some circumferential locations and not others.

Minimising the clearances has conventionally been by virtue of selecting the appropriate clearance for all engine operational points and transient variations. The nominal geometry is subject to manufacturing and build tolerances, thus to ensure a clearance around the whole rotor assembly accommodating the tolerances increases the overall tip clearance area.

Conventional manufacturing of the compressor components involves machining the whole stator casing and all the stator vane tips concentrically and axisymmetrically about the nominal engine or compressor centreline. The diameter of the machining operation is set to avoid any heavy rub that might damage the components.

Therefore, conventional manufacture of compressor (or turbine) components compromises the efficiency because each stage's machined diameter is axisymmetric about a single engine centreline, and the cold build clearance between rotor and stator of each stage is based on accommodating the worst case rub at any local point around the circumference.

U.S. Pat. No. 6,409,471 discloses a method of machining an inner surface of a shroud assembly extending generally circumferentially around a central axis of a gas turbine aircraft engine. The method includes determining pre-machined radial clearances during flight between tips of rotor blades in the engine and the inner surface of the shroud assembly at each of a plurality of circumferentially spaced locations around the shroud assembly. The inner surface of the shroud assembly is machined based on the pre-machined radial clearances to provide a generally uniform post-machined radial clearance during flight between the tips of the rotor blades and the inner surface of the shroud assembly at each of the circumferentially spaced locations around the shroud assembly.

SUMMARY OF INVENTION

To address the problems of known compressors and turbines described above and for the advantages described below, there is provided a method of setting a clearance between a rotor and a stator of a rotor assembly for a turbine engine, the rotor assembly having a plurality of rotor-to-stator stages, the stator having a nominal centreline, the method comprising the steps of (i) correlating in-service rotor-to-stator rub patterns for a rotor-to-stator stage of a number of turbine engines, (ii) setting a position of a machining centreline relative to the nominal centreline of the stator, the position being towards a heavy rub, (iii) machining the stator about the machining centreline, (iv) repeating steps (i) to (ii) for each rotor-to-stator stage of the plurality of the rotor-to-stator stages, wherein the machined stator having been formed by at least two machining steps at different axial positions having different centre-lines.

The machined stator can be formed by at least two machining steps where a first machining step is at a first axial position and a second step is at a second axial position, thus the machining steps at different axial positions have different centre-lines. The first and second axial position can correspond to a first rotor-to-stator stage and a second rotor-to-stator stage.

The method can comprise more than two machining steps at different axial positions or rotor-to-stator stages having different centre-lines. The different centre-lines can be parallel or non-parallel, but the at least two or different centrelines are intended mean that the two centrelines are not coaxial with one another.

The stator may have a nominal diameter; the method may comprise the step of setting a machining diameter of the stator relative to the nominal diameter of the stator.

The method may include the step of setting a machining diameter of the stator relative to the nominal diameter of the stator is completed only where there are no opposing light rub marks.

The method may include the step of setting a machining diameter of the stator relative to the nominal diameter of the stator involves a reduction in the machining diameter.

The method may include the step of machining the stator an axial extent based on the axial extent of the rotor-to-stator rub.

The method may include the step of machining the stator an axial extent based the axial extent of the rotor or stator stage.

The method may include the step of machining the stator includes machining a smooth blend between the two machining steps having different centre-lines.

The method refers to a rotor assembly that may comprise a rotor having an array or radially extending blades and a casing, the clearance is defined between the blades and the casing.

The method refers to a rotor assembly that comprise a rotor having a rotor drum and the stator having an array of radially extending stator vanes, the clearance is defined between the rotor drum and the stator vanes.

The method refers to a stator that may be any one or both a casing or a stator vane.

One advantage of the present invention is to minimise the overall clearance area of any one stage of a rotor assembly to improve efficiency of the rotor assembly.

Another advantage of the present invention is to independently minimise the clearance area of more than one stage of a rotor assembly to improve efficiency of the rotor assembly.

Another advantage of the present invention is to minimise heavy contact or rubbing between rotating and stationary components of a rotor assembly to prevent damage or accelerated wear.

Another advantage of the present invention is to accommodate eccentric orbits of rotor components caused by any one or more of tolerances, out-of-balance and thermal gradients and thermal distortions.

Another advantage of the present invention is to minimise clearances during transient engine conditions.

Another advantage of the present invention is to form a rotor-to-stator stage having a more constant clearance distance around the circumference of the rotor and/or stator. Yet another advantage of the present invention is to form rotor assembly having each rotor-to-stator stage having a more constant clearance distance around the circumference of the rotor and/or stator.

Another advantage of the present invention is minimising over-tip leakage of gases between a rotor and a stator.

BRIEF DESCRIPTION OF THE DRAWINGS

The above mentioned attributes and other features and advantages of this invention and the manner of attaining them will become more apparent and the invention itself will be better understood by reference to the following description of embodiments of the invention taken in conjunction with the accompanying drawings, wherein.

DETAILED DESCRIPTION OF INVENTION

Figure 1:
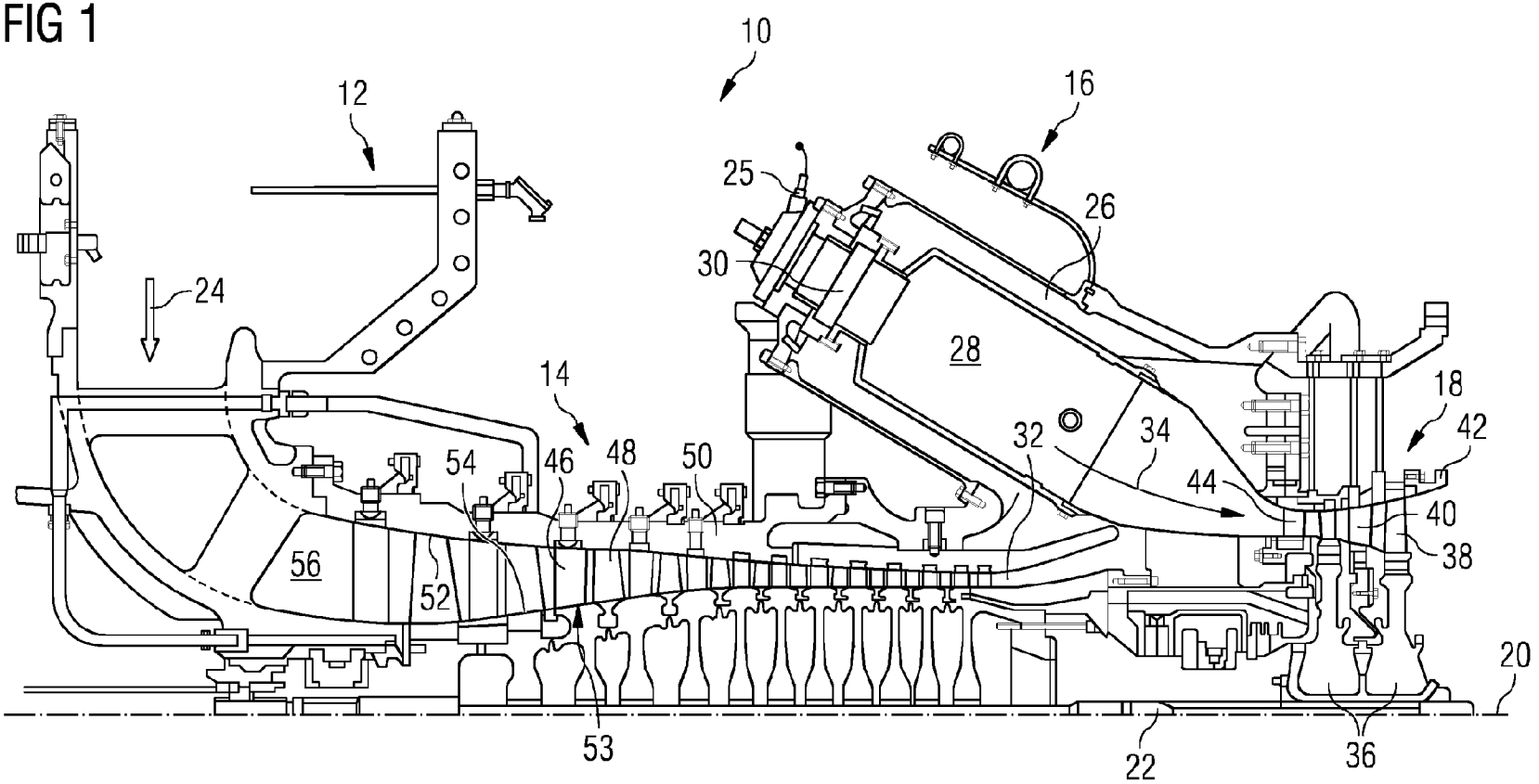
FIG. 1 shows part of a turbine engine in a sectional view and in which the present invention is incorporated, FIG. 2. shows an enlarged view of part of a compressor of the turbine engine and which shows the present invention in greater detail, FIG. 3. is a key for FIGS. 4-6 and indicates the general areas where rub marks might occur and relative directions or movements of a machining centreline relative to a geometric centreline of an in-service stator, in this example a casing.

FIG. 1 shows an example of a gas turbine engine 10 in a sectional view. The gas turbine engine 10 comprises, in flow series, an inlet 12, a compressor section 14, a combustor section 16 and a turbine section 18 which are generally arranged in flow series and generally in the direction of a longitudinal or rotational axis 20. The gas turbine engine 10 further comprises a shaft 22 which is rotatable about the rotational axis 20 and which extends longitudinally through the gas turbine engine 10. The shaft 22 drivingly connects the turbine section 18 to the compressor section 14.

In operation of the gas turbine engine 10, air 24, which is taken in through the air inlet 12 is compressed by the compressor section 14 and delivered to the combustion section or burner section 16. The burner section 16 comprises a burner plenum 26, one or more combustion chambers 28 and at least one burner 30 fixed to each combustion chamber 28. The combustion chambers 28 and the burners 30 are located inside the burner plenum 26. The compressed air passing through the compressor 14 enters a diffuser 32 and is discharged from the diffuser 32 into the burner plenum 26 from where a portion of the air enters the burner 30 and is mixed with a gaseous or liquid fuel. The air/fuel mixture is then burned and the combustion gas 34 or working gas from the combustion is channelled through the combustion chamber 28 to the turbine section 18.

The turbine section 18 comprises a number of blade carrying discs 36 attached to the shaft 22. In the present example, two discs 36 each carry an annular array of turbine blades 38. However, the number of blade carrying discs could be different, i.e. only one disc or more than two discs. In addition, guiding vanes 40, which are fixed to a stator 42 of the gas turbine engine 10, are disposed between the turbine blades 38. Between the exit of the combustion chamber 28 and the leading turbine blades 38 inlet guiding vanes 44 are provided.

The combustion gas from the combustion chamber 28 enters the turbine section 18 and drives the turbine blades 38 which in turn rotate the shaft 22. The guiding vanes 40, 44 serve to optimise the angle of the combustion or working gas on the turbine blades 38.

The turbine section 18 drives the compressor section 14. The compressor section 14 comprises an axial series of guide vane stages 46 and rotor blade stages 48. The rotor blade stages 48 comprise a rotor disc supporting an annular array of blades. The compressor section 14 also comprises a casing 50 that surrounds the rotor stages and supports the guide vane stages 48. The guide vane stages include an annular array of radially extending vanes that are mounted to the casing 50. The guide vanes are provided to present gas flow at an optimal angle for the blades at a given engine operational point. Some of the guide vane stages have variable vanes, where the angle of the vanes can be adjusted for angle according to air flow characteristics at different engine operations conditions.

The casing 50 defines a radially outer surface 52 of the passage 56 of the compressor 14. A radially inner surface 54 of the passage 56 is at least partly defined by a rotor drum 53 of the rotor which is partly defined by the annular array of blades 48 and will be described in more detail below.

The present invention is described with reference to the above exemplary turbine engine having a single shaft or spool connecting a single, multi-stage compressor and a single, one or more stage turbine. However, it should be appreciated that the present invention is equally applicable to two or three shaft engines and which can be used for industrial, aero or marine applications. The term 'rotor assembly' refers to a compressor or a turbine. The term rotor or rotor assembly is intended to include rotating components, including rotor blades and a rotor drum. The term stator or stator assembly is intended to include stationary or non-rotating components, including stator vanes and a stator casing. Thus the term rotor-to-stator is intended to relate a rotating component to a stationary component such as a rotating blade and stationary casing or a rotating casing and a stationary blade or vane. The rotating component can be radially inward or radially outward of the stationary component.

The terms upstream and downstream refer to the flow direction of the airflow and/or working gas flow through the engine unless otherwise stated. The terms forward and rearward refer to the general flow of gas through the engine. The terms axial, radial and circumferential are made with reference to the rotational axis 20 of the engine.

Figure 2:
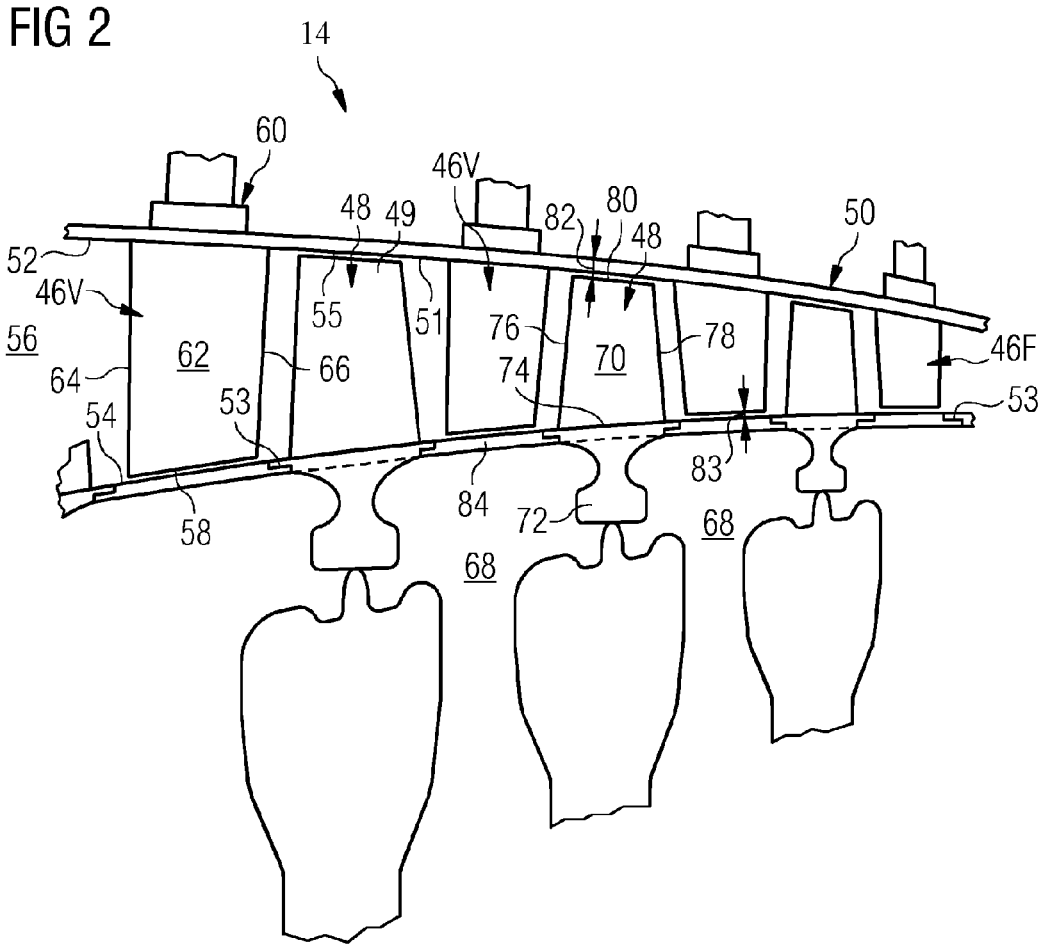

Referring to FIG. 2, the compressor 14 of the turbine engine 10 includes alternating rows of stator guide vanes 46 and rotatable rotor blades 48 which each extend in a generally radial direction into or across the passage 56.

The rotor blade stages 49 comprise rotor discs 68 supporting an annular array of blades 48. The rotor blades 48 are mounted between adjacent discs 68 as shown here, but each annular array of rotor blades 48 could otherwise be mounted on a single disc 68. In each case the blades 48 comprise a mounting foot or root portion 72, a platform 74 mounted on the foot portion 72 and an aerofoil 70 having a leading edge 76, a trailing edge 78 and a blade tip 80. The aerofoil 70 is mounted on the platform 74 and extends radially outwardly therefrom towards the surface 52 of the casing 50 to define a blade tip gap or blade clearance 82.

The radially inner surface 54 of the passage 56 is at least partly defined by the platforms 74 of the blades 48 and compressor discs 68. In the alternative arrangement mentioned above, where the compressor blades 48 are mounted into a single disc the axial space between adjacent discs may be bridged by a ring 84, which may be annular or circumferentially segmented. The rings 84 are clamped between axially adjacent blade rows 48 and are facing the tip of the guide vanes 46. In addition as a further alternative arrangement a separate segment or ring can be attached outside the compressor disc shown here as engaging a radially inward surface of the platforms.

FIG. 2 shows two different types of guide vanes, variable geometry 46V and fixed geometry 46F. The variable geometry guide vanes 46V are mounted to the casing 50 or stator via conventional rotatable mountings 60. The guide vanes comprise an aerofoil 62, a leading edge 64, a trailing edge 66 and a tip 58. The rotatable mounting 60 is well known in the art as is the operation of the variable stator vanes and therefore no further description is required.

The guide vanes 46 extend radially inwardly from the casing 50 towards the radially inner surface 54 of the passage 56 to define a vane tip gap or vane clearance 83 therebetween.

The term 'clearance' is used herein refers to a distance, usually a radial distance, between the rotor and stator. The term 'clearance area' is used herein refers to a total area of the clearance or gap between and around the rotor and stator at any given engine operational condition. The term 'average clearance' can also be used to denote the average distance between the rotor blades and casing and between the stator vanes and the rotor drum for one stage of the rotor assembly.

In-service engines have been inspected for tip rub patterns in an attempt to understand and improve stator-rotor clearances. Evaluation of the rub patterns on a fleet of each engine type has revealed a correlation. Rub patterns on any single engine are different from one rotor/stator stage to another rotor/stator stage; however, the rub patterns on the same rotor/stator stage of a first and a second engine are very similar. From this analysis of rub patterns between engines, it is possible, for any one engine, to optimise the design and manufacture of each rotor and/or stator stage independently. This optimisation reduces clearance where there is no heavy rub mark, and maintains or increases clearance where there is a heavy rub mark. In this way the average clearance for each stage can be reduced without any increased risk of damage from heavy rubs between rotor and stator. This means that the average increase in tip clearance for the whole rotor assembly is reduced and the efficiency of the compressor is increased to a higher level than would be possible by the known process of machining all rotor/stator stages axisymmetrically around the engine centre-line.

The term 'light rub' is used to denote a contact between rotor and stator components that does not cause unacceptable damage to either component. The term 'heavy rub' is used to denote a contact between rotor and stator components that causes unacceptable damage to either or both components. A light rub and a heavy rub can be distinguished by virtue of the circumferential extent or length of the rub mark. In general, the longer the circumferential extent the heavier the rub has been. Thus when inspecting a casing for example, the locations of the ends of the rub are recorded. For example, and referring to a clock face to describe circumferential locations, a rub mark on a casing might start in the 2 O'clock position and end at the 6 O'clock position. This rub length is approximately ⅓ of the complete circumferential length of the casing and because of the relative subscribed rotor path and casing curvature this length will indicate a heavy rub has occurred and approximately across the middle of the rub mark (the 4 O'clock position). From experience, a heavy rub can be determined by a rub mark length greater than a predetermined rub length. Rub marks below the predetermined length are deemed light rubs. Thus in correlating rub marks across related engines and stages, the circumferential position of the start and the end of rub marks is measured and recorded.

The present invention is a method of machining the stator to achieve the minimal clearance area around each rotor and/or stator stage. The machining of the stator comprises machining either or both the casing and the stator vane tips. The method is applied on a stage by stage basis, such that the resultant casing or a circumference defined by the stator vane tips is formed by at least two stages or regions having different machining centre lines. In addition, the resultant casing or a circumference defined by the stator vane tips is formed by at least two stages or regions having different nominal diameters.

The different machining centre lines for at least two stages are off-set from one another when viewed along the engine's rotational axis 20 for example. The different machining centre lines for each stage or group of stages are effectively arranged along the engine's axis 20 although they do not need to be immediately adjacent to one another. For example, two or more adjacent stages could have machining centre lines that are in-line with each other and the next stage's machining centreline could then be off-set. The term 'different machining centre lines' means that one stage's machining centre-line might be concentric with the engine's rotational axis and/or the casing's nominal centreline, but another stage's machining centre-line is different or off-set from and therefore not concentric with the engine's rotational axis and/or the casing's nominal centreline.

For a better understanding of the present invention, three examples are described with reference to their figures. It should be appreciated that the machining centre-lines are applicable equally to the casing or the circumference defined by the stator vane tips. For convenience only the casing is discussed below.

Considering a casing, inspected after operation. The ideal situation for a minimum clearance area is a light rub mark on the casing caused by the blade tips all the way round the casing circumference. This means that the blades have touched the casing everywhere at some time, but have never suffered a heavy rub which could damage the blades. In this situation, the clearance cannot be reduced without causing a heavy rub, and the clearance should not be increased because this would cause increased over tip leakage and hence reduced efficiency.

However this ideal situation does not always occur. The examples described below show an in-service rub pattern on the left and in accordance with the present invention the adjustments to the machining centre-line on the right for a newly manufactured casing.

Figure 3:
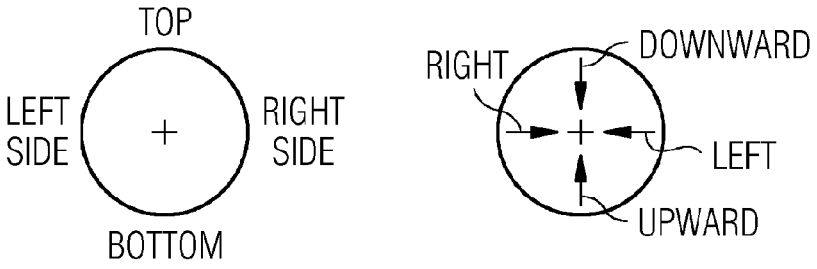
Figure 4:
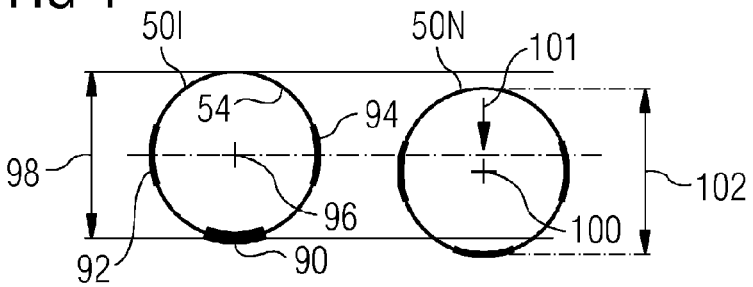
FIG. 4-6 show first, second and third examples of rub patterns of an in-service rotor or stator stage of a rotor assembly and the position of a machining centreline relative to a geometric centreline of the in-service casing and relative machining diameter in accordance with the present invention.
Figure 5:
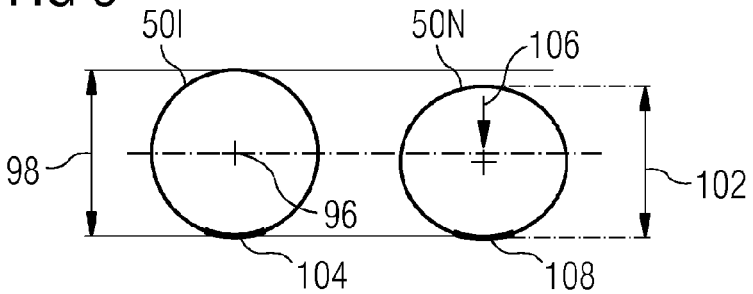
Figure 6:
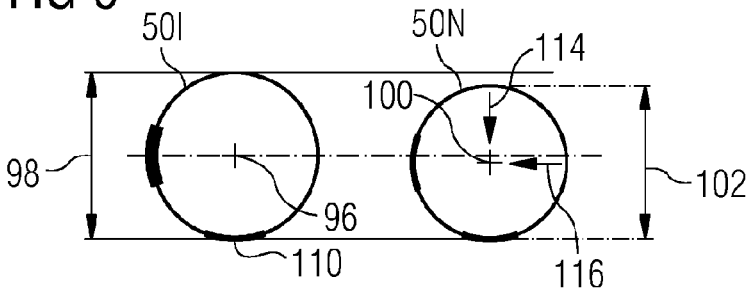

FIG. 3 is a key for FIGS. 4-6 and indicates the general areas where rub marks might occur and relative directions or movements of a machining centreline relative to a geometric centreline of an in-service casing or the circumference defined by the stator vane tips. In these examples, the geometric centrelines and rotational axis 20 of the engine is generally horizontal to the ground.

Example 1 is shown in FIG. 4. The in-service casing 50I has a rub pattern about a single rotor stage (blade tip against casing surface 54) comprising a heavy rub mark 90 at the bottom, light rub marks at both sides 92, 94 and no rub marks at the top. The in-service casing 50I has a geometric centre-line 96 and a diameter 98. In other words, the geometric or nominal centre-line 96 has a geometric or nominal diameter 98. In this example and for the same rotor stage, the casing machined with a machining centre-line 100 relative to the geometric centre-line 96, which is downward (arrow 101) or towards the heavy rub. This adjustment of the machining centre line position creates or increases the clearance at the bottom of the new casing 50N in the location of the heavy rub. The clearance at the top of the casing is reduced and there is no change in the clearance at the sides. In this example, there is no change in the machining diameter 102, which is the same as the original or in-service diameter 98.

Depending on the amount of downward movement of the machining centre-line 100, when operated in-service this new casing 50N will incur light-rubs at the bottom, sides and is likely to have no rub or a light rub at the top. In addition, the risk of damage to the rotor blades and stator vanes is reduced by avoiding the heavy rub, while maintaining the same casing diameter.

Example 2 is shown in FIG. 5 where like elements have the same reference numbers as in FIG. 3. The in-service casing 50I has a rub pattern about a single rotor stage comprising a light rub 104 at the bottom, no rub marks at the top and no rub marks at the sides. In this example, the necessary adjustments to reduce clearances are to reduce machining diameter 102 and hence a reduction of the internal diameter of the new casing 50N compared to an in-service casing. In addition, the machining centreline 100 is moved downward (arrow 106) or towards the light rub mark 104 so that the clearance at the bottom is not changed. In this example, the downward movement corresponds to the reduction in half the reduction in diameter. Depending on the amount of downward movement of the machining centre-line 100 and the reduction in machining diameter 102, when operated in-service this new casing 50N will incur a light rub 108 at the bottom and is likely to have no rub or a light rub at the top and the sides. The tip clearance area is therefore reduced, increasing the efficiency of the compressor, without causing a heavy rub with risk of damage to the rotating blades.

Example 3 is shown in FIG. 6 where like elements have the same reference numbers as in FIGS. 3 and 4. The in-service casing 501 has a rub pattern about a single rotor stage comprising a light rub 110 at the bottom, a heavy rub 112 on the left, no rub on the right and no rub at the top. In this example, the necessary adjustments to reduce clearances are a reduction in the machining diameter 102 relative to the in-service casing diameter 98 and a combination of a downward movement (arrow 114) and a left-ward movement (arrow 116) of the machining centreline 100. This combination of adjustments will leave the clearance at the bottom unchanged (a light rub) and the clearance at the top being reduced. Also the combination of adjustments will move the machining centreline to the left so the clearance on the left is increased and the clearance on the right is reduced. Thus depending on the amount of movement of the machining centre-line 100 and the reduction in machining diameter 102, when operated in-service this new casing 50N will incur a light rub 108 at the bottom and the left side, but is likely to result in no rub or a light rub at the top and the right side.

It should be understood that the amount of displacement of the machining centre-line 100 relative to the geometric centre-line 96 and where required the reduction in the machining diameter 102 relative to the in-service casing diameter 98 will each depend on a number of factors. These factors will include the circumferential extent of a rub mark, how heavy the rub mark is and the statistical confidence of the in-service rub-mark correlation. For example, it could be found that the middle stages of a compressor show a heavy rub at the bottom of the casing and no rub at the top. This could be due to a temperature gradient between the top and bottom halves of the casing, which occurs when the engine stops. Such a temperature gradient can causes a thermal distortion or bending of the rotor and/or casing between the bearings supporting the shaft. This could cause a temporary condition where the radial tip clearance at the bottom of the engine is small, about halfway between the bearings. If the engine is restarted in this condition, a heavy rub could occur only at the middle stages. The rotor and stator are concentric at the bearings, so no heavy rub is seen at the first or last compressor stages. To apply the present invention to this observed condition, the machining centreline of the casing for the middle compressor stages could be moved downwards, which would prevent the heavy rub at the bottom and reduce the tip clearance at the top of the compressor. It could also be beneficial to reduce the overall internal machined diameter of the new casing, depending on any observed rub on the left or right side of casings returned from operation.

Figure 7:
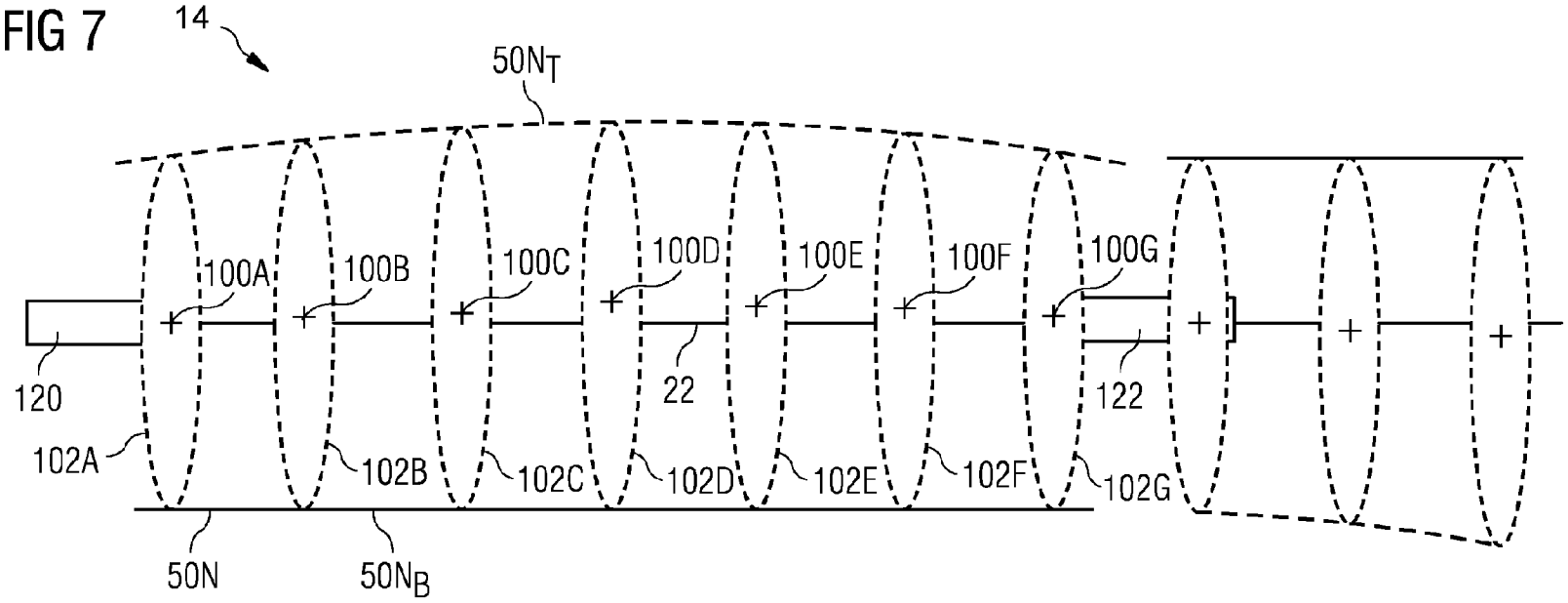
FIG. 7 is a schematic illustration of an example of a rotor assembly in accordance with the present invention and having a number of off-set machined rotor or stator stages.

FIG. 7 is a schematic illustration of an example of a rotor assembly in accordance with the present invention and having a number of off-set machined rotor or stator stages. The rotor assembly, for example the compressor 14, is arranged about shaft 22. Shaft 22 is held by a first bearing 120 and a second bearing 122; the shaft 22 extends through the second bearing 122. The dashed elliptical lines indicate machining circumferences. These machining circumferences are those for the new casing 50N.

In this example, the shaft 22 and associated rotating components of an in-service engine set, has formed an arcuate rotor blade tip path causing heavy rubbing generally at the top of the casing 501. For example, this could be caused by thermal gradients as described above. At the bottom 50$N_B$ of the casing 50N, in-service rub pattern analysis has indicated only slight rubs or no rubs. At the top 50$N_T$ of the casing 50N, in-service rub pattern analysis has indicated heavy rubs. In series order from the first bearing 120, machining cutter or turning paths have diameters 102A-D increasing and their machining centrelines 100A-D have been translated upwardly by increasing amounts; and then the diameters from 102D to 102G decrease and machining centrelines from 100D to 100G decrease in distance from the nominal or geometric centreline of the casing at the second bearing 122.

Thus as has been described the present invention is a method of setting a clearance between a rotor and a stator of a compressor or turbine assembly. Where a fleet of in-service engines is found to have consistent rub patterns, these rub patterns are correlated. From the correlated rub patterns, a position of a machining centreline relative to the nominal centreline of the stator is determined and set. The machining centreline is generally moved or positioned towards a heavy rub. As each rotor-to-stator stage is machined about its machining centreline, a machined stator is formed by at least two machining steps having different centre-lines. In other words the machined stator has been formed by at least two machining steps at different axial positions having different centre-lines. The machined stator can be formed by at least two machining steps where a first machining step is at a first axial position and a second step is at a second axial position, thus the machining steps at different axial positions have different centre-lines. The first and second axial position can correspond to a first rotor-to-stator stage and a second rotor-to-stator stage. The method can comprise more than two machining steps at different axial positions or rotor-to-stator stages having different centre-lines. The different centre-lines can be parallel or non-parallel, but the at least two or different centrelines are intended mean that the two (machined) centrelines are not coaxial with one another.

This method could produce a casing having a stepped surface. Having steps in an aerodynamic surface can be undesirable for aerodynamic reasons and therefore the method further includes machining a smooth blend across and/or between two axially adjacent machining steps that have different centre-lines and/or diameters. A smooth blend may be introduced on the surface 54 from one stage to the next stage downstream thereof. The smooth blend may occur over all or part of the axial space 51, 53 (see FIG. 2) between rotor stages and the adjacent stator vanes, so even if each individual stage is optimised for tip clearance according to the invention, it is always possible to shape the casing between each rotor stage and the adjacent stators so that there are no sharp steps.

In addition or instead the smooth blend may extend across each stage. Smoothly blending between stage positions on a casing is further advantageous where the casing walls 52, 54 are frusto-conical in shape, as shown, rather than a cylindrical because a frusto-conical casing may include varying conical angles which might exacerbate any two axially adjacent machining steps that have different centre-lines and/or diameters. Similarly, grinding stator vane tips across their chord lengths will advantageously involve a smooth transition from the vane's leading to trailing edges.

Furthermore, it should be appreciated that the diameter of a stage is intended to be representative to a potentially varying diameter across that stage's axial extent. As can be seen in FIG. 2 the gas passage is bounded by the conical walls 52, 54, which mean that the diameter of one stage is not constant between an upstream and a downstream part of the stage.

It is known to use abradable coatings on casing which are designed to operate with the minimum tip clearance by virtue of allowing the rotor and stator to rub. In FIG. 2 an abradable coating 55 is applied to the casing radially outwardly of the blades 48 and defines the clearance 82 with the tip 80 of the blade. Thus in correlating in-service rotor-to-stator rub patterns, setting machining centreline off-set positions and setting a machining diameter, account is made of whether the stage has an abradable coating or lining. Thus the present invention is further enhanced by having the step of reducing the clearance on stages with an abradable coating than on stages without an abradable coating.

Still further in the correlation of in-service rotor-to-stator rub patterns, setting machining centreline off-set positions and setting a machining diameter to determine a radial clearance, account is made of the conical angle of the walls. The conical angle is defined as the angle between the geometric centreline of the stator and the surface of the gas passage 52, 54. It is possible that shallow conical angles allow smaller radial tip clearances because relative axial movements between rotor and stator do not open or close the gap or clearance as much as where there are steeper conical angles of the walls 52, 54. Steeper conical angles can be seen on the upstream stages in FIG. 2 and shallower conical angles can be seen on the downstream stages.

In a further aspect of the present invention, it is possible to change the angle of the cone in the casing where a deeper or heavier rub is found adjacent and between the leading edge and trailing edge of the rotor blade. For example, there may be a heavier rub at the leading and a shallower rub at the trailing edge. This change to the conical angle may be made in accordance with the present invention and by virtue of a varying the diameter adjustment or setting across a stage in association with setting a position of a machining centreline relative to the nominal centreline of the stator.

While the invention has been illustrated and described in detail for a preferred embodiment the invention is not limited to these disclosed examples and other variations can be deducted by those skilled in the art in practicing the claimed invention.

The invention claimed is:

1. A method of setting a clearance between a rotor and a stator of a rotor assembly for a turbine engine, the rotor assembly having a plurality of rotor-to-stator stages, the stator having a nominal centerline, wherein the rotor assembly comprises either;

the rotor assembly having the rotor including an array of radially extending blades and the stator including a casing and the clearance is defined between the blades and the casing, or the rotor assembly having the rotor including a rotor drum and the stator having an array of radially extending stator vanes and the clearance is defined between the rotor drum and the stator vanes, wherein the method comprising:

(i) correlating in-service rotor-to-stator rub patterns for a rotor-to-stator stage of a number of turbine engines, (ii) setting a position of a machining centerline relative to the nominal centerline of the stator, the position being towards a heavy rub, (iii) machining the stator about the machining centerline, (iv) repeating steps (i) to (iii) for each rotor-to-stator stage of the plurality of the rotor-to-stator stages, wherein the machined stator having been formed by at least two machining steps at different axial positions having different center-lines.

2. The method of setting a clearance between a rotor and a stator of a rotor assembly as claimed in claim 1, wherein the stator has a nominal diameter, the method further comprises:

setting a machining diameter of the stator relative to the nominal diameter of the stator.

3. The method of setting a clearance between a rotor and a stator of a rotor assembly as claimed in claim 2, wherein the step of setting a machining diameter of the stator relative to the nominal diameter of the stator is completed only where there are no opposing light rub marks.

4. The method of setting a clearance between a rotor and a stator of a rotor assembly as claimed in claim 2, wherein the step of setting a machining diameter of the stator relative to the nominal diameter of the stator involves a reduction in the machining diameter.

5. The method of setting a clearance between a rotor and a stator of a rotor assembly as claimed in claim 1, wherein the method further comprises:

machining the stator an axial extent based on the axial extent of the rotor-to-stator rub.

6. The method of setting a clearance between a rotor and a stator of a rotor assembly as claimed in claim 1, wherein the method further comprises:

machining the stator an axial extent based the axial extent of the rotor or stator stage.

7. The method of setting a clearance between a rotor and a stator of a rotor assembly as claimed in claim 1, wherein the step of machining the stator includes machining a smooth blend between the two machining steps having different center-lines.

8. The method of setting a clearance between a rotor and a stator of a rotor assembly as claimed in claim 1, wherein the rotor assembly comprises a rotor having the array of radially extending blades and the casing, the clearance is defined between the blades and the casing.

9. The method of setting a clearance between a rotor and a stator of a rotor assembly as claimed in claim 8, wherein the casing comprises an abradable coating at least in a location radially outwardly of the rotor, the method further comprising:

reducing the clearance on stages with an abradable coating to a greater extent than on stages without an abradable coating.

10. The method of setting a clearance between a rotor and a stator of a rotor assembly as claimed in claim 1, wherein the rotor assembly comprises a rotor having the rotor drum and the stator having the array of radially extending stator vanes, and the clearance is defined between the rotor drum and the stator vanes.

11. The method of setting a clearance between a rotor and a stator of a rotor assembly as claimed in claim 1, wherein the stator is any one or both of the casing or the stator vane.

12. The method of setting a clearance between a rotor and a stator of a rotor assembly as claimed in claim 1, wherein the step of correlating in-service rotor-to-stator rub patterns includes recording the circumferential positions of the start and the end of a rub to determine a rub length.

13. The method of setting a clearance between a rotor and a stator of a rotor assembly as claimed in claim 12, wherein the step of correlating in-service rotor-to-stator rub patterns includes setting a predetermined rub length where a rub length greater than the predetermined length is indicative of the heavy rub.

14. The method of setting a clearance between a rotor and a stator of a rotor assembly as claimed in claim 13, where the (ii) setting step comprises setting the position of the machining centerline towards the heavy rub to increase the clearance at the heavy rub.

15. The method of setting a clearance between a rotor and a stator of a rotor assembly as claimed in claim 14, wherein a rub length less than the predetermined length is indicative of a light rub and wherein the (ii) setting step further comprises setting the position of the machining centerline to maintain the clearance at the light rub.

16. The method of setting a clearance between a rotor and a stator of a rotor assembly as claimed in claim 1, wherein the casing of the stator surrounds the plurality of the rotor-to-stator stages and supports the array of radially extending stator vanes with rotatable mountings.

17. The method of setting a clearance between a rotor and a stator of a rotor assembly as claimed in claim 1, wherein the turbine engine further comprises:

a compressor section;

a combustor section; and a turbine section;

a shaft;

wherein the compressor section, the combustor section and the turbine section are generally arranged in flow series and generally in a direction of a longitudinal axis;

wherein the shaft is rotatable about the longitudinal axis and wherein the shaft drivingly connects turbine section to the compressor section;

wherein the rotor assembly is one of the compressor section and the turbine section and wherein the different axial positions correspond to different stages of the rotor assembly spaced apart along the longitudinal axis.

18. The method of setting a clearance between a rotor and a stator of a rotor assembly as claimed in claim 17, wherein the combustor section comprises a burner plenum, a plurality of combustion chambers positioned within the burner plenum and a plurality of burners wherein a respective burner is fixed to each combustion chamber.

* * * * *